United States Patent [19]

Zwick et al.

[11] 4,197,712

[45] Apr. 15, 1980

[54] FLUID PUMPING AND HEATING SYSTEM

[76] Inventors: Eugene B. Zwick, 16841 Edgewater La., Huntington Beach, Calif. 92649; William D. Brigham, 14361 Suffolk St., Westminster, Calif. 92683

[21] Appl. No.: 898,999

[22] Filed: Apr. 21, 1978

[51] Int. Cl.[2] ..... F17C 7/02

[52] U.S. Cl. ..... 62/53; 60/618; 60/648

[58] Field of Search ..... 62/52, 53; 60/618, 648

[56] References Cited

U.S. PATENT DOCUMENTS

| | | | |
|---|---|---|---|
| 3,068,659 | 12/1962 | Marshall, Jr. | 62/53 |
| 3,229,472 | 1/1966 | Beers | 62/53 |
| 4,031,705 | 6/1977 | Berg | 60/618 |
| 4,036,028 | 7/1977 | Mandrin | 62/52 |

*Primary Examiner*—Ronald C. Capossela
*Attorney, Agent, or Firm*—Ralph B. Pastoriza

[57] ABSTRACT

The system utilizes a heat engine which provides shaft power and heat such as a conventional diesel engine in which part of the shaft power drives a pump for fluid to be heated; for example, a cryogenic liquid. The engine heat is used to heat and/or vaporize the cryogenic liquid in a heat exchanger. The heat available from the engine for transfer to the liquid to be vaporized is proportional to the power level of the engine. The heat required to heat the fluid to a desired temperature is proportional to the flow rate of the cryogenic liquid.

By providing a loading on the engine which is proportional to the fluid flow rate, a sufficient amount of heat is provided to effect complete vaporization of the liquid, the amount of heat being directly proportional to the flow rate of the liquid. An engine radiator is provided to get rid of excess heat so that the heat supplied equals the heat required. The loading of the engine can be accomplished by a power absorbing hydraulic drive connected to the engine shaft with the hydraulic medium used to drive the cryogenic liquid pump, or alternatively by providing back pressure on an engine coolant pump, or by providing back pressure directly on the cryogenic fluid being pumped.

18 Claims, 5 Drawing Figures

FLUID PUMPING AND HEATING SYSTEM

This invention relates generally to fluid pumping and heating systems and more particularly to an improved system for pumping and heating and/or vaporizing fluids such as cryogenic liquids.

BACKGROUND OF THE INVENTION

This invention is concerned with adding heat to a fluid which is being pumped. The heat serves to increase the temperature of the fluid, or to change its state from liquid to gas, or both. When there is a change of state involved, the process is commonly called vaporization. This can only occur when the pressure at which the fluid is vaporized is below the critical pressure. When the fluid is heated at pressures in excess of the critical pressure, the temperature will always increase, but it is still common to speak of changing the fluid from a liquid to a gas even at supercritical pressures, and this process is also commonly called vaporization. For the purposes of this invention no distinction is made between subcritical and super-critical pressures. When the phrase "heating a fluid to a desired temperature" is used herein, it should be understood that this includes increasing the fluid temperature, or vaporizing the fluid, or any combination of increasing the temperature and vaporizing the fluid so that the desired final fluid temperature and state are achieved.

Systems for pumping and heating a fluid to a desired temperature, as for example heating liquid nitrogen from −320° F. to provide gaseous nitrogen at a desired pressure and temperature, for example 5000 psi and 70° F., are well known in the art. The vaporized nitrogen can be used to displace fluid in oil wells, or for purposes of purging tanks in ships or purging pipelines, or for simply filling nitrogen gas storage bottles.

Heretofore, the known systems usually required burners; direct fired units, boiler systems and the like to effect the heating and/or vaporization. Thus, in addition to an internal combustion engine for driving the cryogenic pump, an additional burner for vaporization is used.

Systems of the foregoing type have certain disadvantages. First, the increased complexity of the system leads to reduced reliability. The operation of the system requires that both the engine and the burner be started and controlled during the liquid pumping and vaporizing process. Experience has shown that systems of this type suffer from field breakdowns caused primarily by inability to start or maintain proper operation of the burner. In contrast to the burner systems, the engines are generally reliable from the standpoint of starting and maintaining controlled operation.

A second disadvantage to the use of burners, particularly of open flame type, is the potential hazard they pose in certain environments where flammable or explosive materials are present.

A third disadvantage of burner systems is that they generally transfer heat from relatively high temperature gases by means of heat exchangers which are prone to failure or "burn out".

There are also known pumping and heating systems which use heat rejected from internal combustion engines such as Otto-cycle engines to vaporize small quantities of fluid in which the work required to pump the fluid is quite small compared to the power rating of the engine. These systems depend on the relatively poor part-load fuel economy of the Otto-cycle engine and the very great disparity between the power available and the power required. They are not practical for pumping and vaporizing significant quantities of liquid.

BRIEF DESCRIPTION OF THE PRESENT INVENTION

Bearing the foregoing in mind, the present invention contemplates an improved fluid pumping and heating method and system which overcomes the foregoing mentioned problems associated with prior art systems.

This invention is concerned with pumping and heating a fluid by utilizing a heat engine. Heat engines are devices which convert heat into shaft power. The heat is supplied from either the combustion of a fuel or from an external source of heat. The engine converts a portion (always less than 100%) of this heat into shaft power and rejects the remainder of the heat.

The rejected heat may leave the engine by means of heat transfer to a cooling medium.

For open cycle engines such as diesel engines, air passes through the engine and leaves as exhaust gas. Some of the rejected heat is carried away by this exhaust gas which leaves the engine at a higher temperature than the temperature of the entering air.

Heat rejected from a heat engine is commonly called "waste" heat because this heat is used by the engine but is not converted into shaft power. In the present invention this heat is not wasted. It is used to heat the fluid being pumped. The present invention is particularly concerned with those circumstances in which the heat required is less than the heat which may be conveniently extracted from the so-called waste heat. Under these conditions, the methods of this invention increase the engine power level so as to increase the amount of heat rejected from the engine so that an adequate amount can be extracted for heating the fluid.

More particularly, the basic method of the present invention includes the step of pumping the fluid to be heated along a flow path. A heat engine which supplies shaft power and heat such as a diesel engine is provided and part of the shaft power is used to effect the pumping. This shaft power is then further loaded so that the engine operates at a greater power level than necessary to effect the pumping to thereby provide increased heat from the engine. Finally, a heat exchange is effected between the engine heat and the fluid passing along the flow path to thereby heat the fluid, the amount of heat provided being directly proportional to the flow rate of the fluid. As a consequence, separate burners, direct fired units, boiler systems and the like, are not required. Moreover, the heat of the engine which is normally wasted is utilized in the heating process, thereby providing a more efficient system.

The basic apparatus for carrying out the method includes a heat exchanger and fluid pump for passing the fluid to be heated through the heat exchanger. The heat engine which supplies the power to drive the pump rejects heat by means of either an exhaust gas stream or a cooling medium or both. A portion of this heat is transferred to the fluid to be heated in the heat exchanger. The apparatus also includes a means for loading the engine by absorbing shaft power from the engine so as to provide sufficient heat to heat the fluid to a desired temperature. The loading means is such that the amount of heat provided is directly proportional to the flow rate of the fluid being pumped.

When heat is rejected from an engine by a circulating cooling medium into the surrounding air by means of a radiator, controls may be provided to limit the amount of such heat transfer. These include valves which allow the cooling medium to bypass the air cooling portion of the radiator, and shutters and fan controls which limit the rate of heat transfer from the radiator to the air. In the description of the present invention, it is to be understood that the use of phrases such as "the cooling medium passes through the radiator" includes the possibility that the controls will bypass the cooling medium around the air cooling portion of the radiator.

In a principal embodiment of the invention, the loading means includes a hydraulic drive connected to a fluid pump such as a cryogenic pump, this hydraulic drive in turn being powered from a hydraulic pump connected to the engine shaft. A back pressure valve is provided in the circulation path of the hydraulic medium for the hydraulic pump thereby loading the hydraulic pump and the engine shaft. The engine includes a coolant medium and a radiator for the coolant medium. The coolant pump is driven by the engine for circulating the coolant medium through the engine, the heat exchanger, and the radiator. The coolant picks up heat from the engine and from the hydraulic medium and delivers this heat to the fluid being pumped in the heat exchanger. Any excess heat is then removed from the coolant in the radiator.

In a second embodiment, a back pressure is provided on the coolant medium by a back pressure valve thereby loading the coolant pump driven by the engine shaft and thus loading the shaft.

A third embodiment of the invention is one in which the step of loading the engine shaft includes the step of providing back pressure on the fluid along the flow path by means of a suitable back pressure valve with the heat being transferred from the engine by means of heat exchange with the engine coolant.

A fourth embodiment of the invention is similar to the third embodiment except that the heat is transferred to the fluid from the engine exhaust gas.

In all embodiments, the operation of the fluid or cryogenic pump is derived from the engine shaft. The amount of engine heat available is proportional to the engine shaft power. The amount of heat required to heat the fluid being pumped to a desired temperature is proportional to the flow rate of the fluid. By loading the engine so that the engine shaft power is proportional to the fluid flow rate, the amount of heat available is proportional to the fluid flow rate and hence can be made approximately equal to the amount of heat required.

Because the purpose of this invention is primarily to heat a pumped fluid, it will be instructive to consider the heat balance of a typical system. All of the energy required for operation of the system is provided by combustion of fuel in a diesel engine. For a typical diesel engine, the specific fuel consumption is 0.41 lbs/HpHr of diesel fuel with a heating value of approximately 19,500 BTU/lb, for a total heat content of 8000 BTU/HpHr. The diesel engine drives a hydraulic pump and the hydraulic medium drives a cryogenic pump to pump liquid nitrogen. The engine is loaded by the hydraulic pump which pumps through a backpressure valve set at a pressure level higher than the pressure required to operate the cryogenic pump drive. The heat for vaporizing the liquid nitrogen is obtained from the work done on the nitrogen and the hydraulic fluid, from the engine heat through the engine coolant, and possibly the engine exhaust gas.

Of the 8000 BTU/HpHr released in the engine by the fuel, 2545 BTU/HpHr is converted into shaft power which is supplied to the hydraulic pump and coolant pump. The engine coolant acquires a portion of the heat (2100 BTU/HpHr) in cooling the engine. The remainder, 3355 BTU/HpHr, is carried away by the engine exhaust. (A small amount of the exhaust heat, 240 BTU/HpHr, could be transferred to the coolant by using a standard water cooled exhaust manifold).

The shaft power drives the hydraulic pump which transfers a portion of this energy into pump work in the nitrogen pump. The balance of the hydraulic pump work including pump inefficiency appears as heat in the hydraulic oil and is rejected into coolant in an oil-coolant heat exchanger.

Heat from the coolant is transferred to the nitrogen in the vaporizer. Any excess is rejected to the air which passes over the engine radiator. When no nitrogen is being pumped, the radiator rejects all of the coolant heat.

For a typical application, the nitrogen will be pumped to 10,000 psi for injection into oil wells. The theoretical work required to pump 1 lb/sec of nitrogen to 10,000 psi in the liquid state at a density of 50.5 lbs/ft$^3$ is 51.8 Hp. The increase in enthalpy required to convert liquid nitrogen at −320° F. to gaseous nitrogen at 70° F. is 186 BTU/lb. At 1 lb/sec nitrogen flow rate the system requires approximately 670,000 BTU/Hr. This is 50% more than the total heat of combustion of all of the fuel required to drive the engine with 51.8 Hp. And of course, not all of this heat could be transferred to the nitrogen.

In a system designed in accordance with the present invention, a hydraulic medium flow rate of 1 gallon per second might be selected to pump 1 lb per second of liquid nitrogen. Then without allowing for component inefficiencies, we would need a hydraulic pressure of 1480 psi to supply the power needed by the cryogenic pump.

In order to ensure an adequate heat supply to vaporize the nitrogen without resorting to an engine exhaust heat exchanger, the back pressure valve must be set to 4120 psi. The engine will then deliver 144 Hp and the engine work output together with the heat available from the engine coolant will total the 670,000 BTU/Hr needed to heat the nitrogen.

If a heat exchanger is provided which can recover 50% of the exhaust gas energy, then a back pressure of 3025 psi will provide 106 Hp which will provide sufficient heat.

It should be noted that it is not necessary to distinguish between the enthalpy added to the liquid nitrogen by pumping and that added by heat transfer. A decrease in the pressure level of the pumped nitrogen only results in greater heat content in the hydraulic oil which must be transferred first to the coolant and then to the nitrogen.

In this system, the hydraulic medium is used to drive the cryogenic pump. To reduce the nitrogen flow rate to 0.5 lbs/sec, the hydraulic medium flow rate would be reduced to 0.5 gal/sec. The heat required would be cut in half. By keeping the back pressure fixed, the engine power and hence the heat available will also be cut in half. The available heat will thus continue to match the heat required. In fact this match will occur at any flow rate as long as the engine specific fuel consumption remains unchanged.

BRIEF DESCRIPTION OF THE DRAWINGS

A better understanding of this invention as well as further advantages thereof will be had by now referring to the accompanying drawings in which.

DETAILED DESCRIPTION OF THE INVENTION

Figure 1:
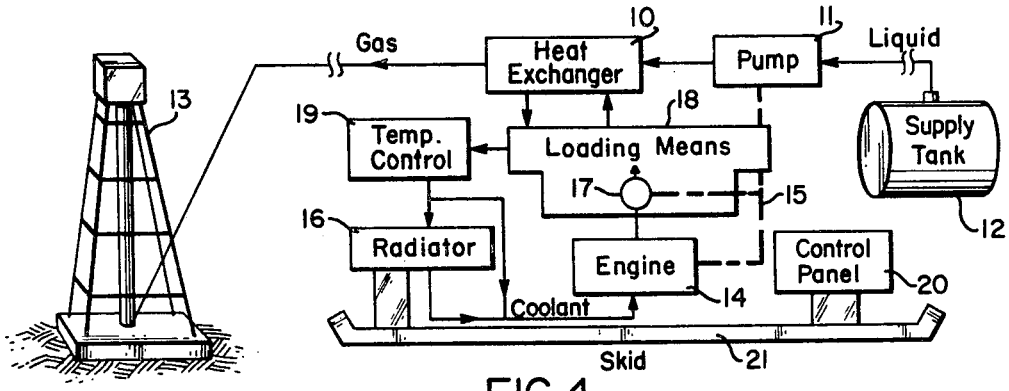
FIG. 1 is a schematic block diagram illustrating the basic method and basic components making up the vaporizer system.

Referring first to the top portion of FIG. 1, the vaporizer system includes a vaporizer heat exchanger 10 positioned in the flow path along which fluid to be vaporized is pumped as by a fluid pump 11 from a suitable supply tank 12.

Where the fluid to be vaporized constitutes a cryogenic liquid such as nitrogen, the resulting gaseous nitrogen at the outlet of the heat exchanger 10 might be utilized as a fluid displacement medium for an oil well indicated schematically at 13. While the principal embodiment of this invention will be described with respect to vaporization of a cryogenic liquid such as nitrogen, it should be understood that the basic method and system are applicable to the heating and/or vaporization of other fluids.

Still referring to FIG. 1 there is shown in the lower center portion a heat engine 14 which may be any suitable type of heat engine such as a gasoline engine or diesel engine which provides shaft power as well as heat. In FIG. 1, the shaft for engine 14 is schematically indicated by the heavy dashed-dot line 15, part of the power from the shaft being utilized to drive the fluid pump 11.

Associated with the engine 14 is radiator 16 shown to the left in FIG. 1 through which a coolant medium is circulated as by means of a coolant pump 17 driven by the shaft 15. A loading means for loading the shaft of the engine 14 is indicated by the block 18 and takes two different forms in the two embodiments to be subsequently described. In both of these embodiments, however, the coolant pump 17 will pass a cooling medium from the engine 14 through the heat exchanger 10 in heat exchanging relaltionship with the fluid from pump 11 to vaporize this fluid, and thence through a temperature control 19 and the radiator 16 back to the heat engine. As will become clearer as the description proceeds, the temperature control 19 controls the radiator in a manner to radiate away excess heat in the coolant not absorbed in the heat exchanger 10 during the vaporization process.

Also illustrated to the lower right of FIG. 1 is a control panel 20 which incorporates the various pressure and temperature gauges and engine monitoring equipment.

It will be noted in FIG. 1 that there is not required any separate burner or boiler for effecting the vaporization and as a consequence, the entire system is more portable than would otherwise be the case. In this respect, there is indicated schematically in FIG. 1 a skid structure 21 for supporting the basic components described so that the entire system can be transported to a particular site such as an oil field or even to an offshore drilling rig and vaporization of the cryogenic liquid nitrogen carried out.

Figure 2:
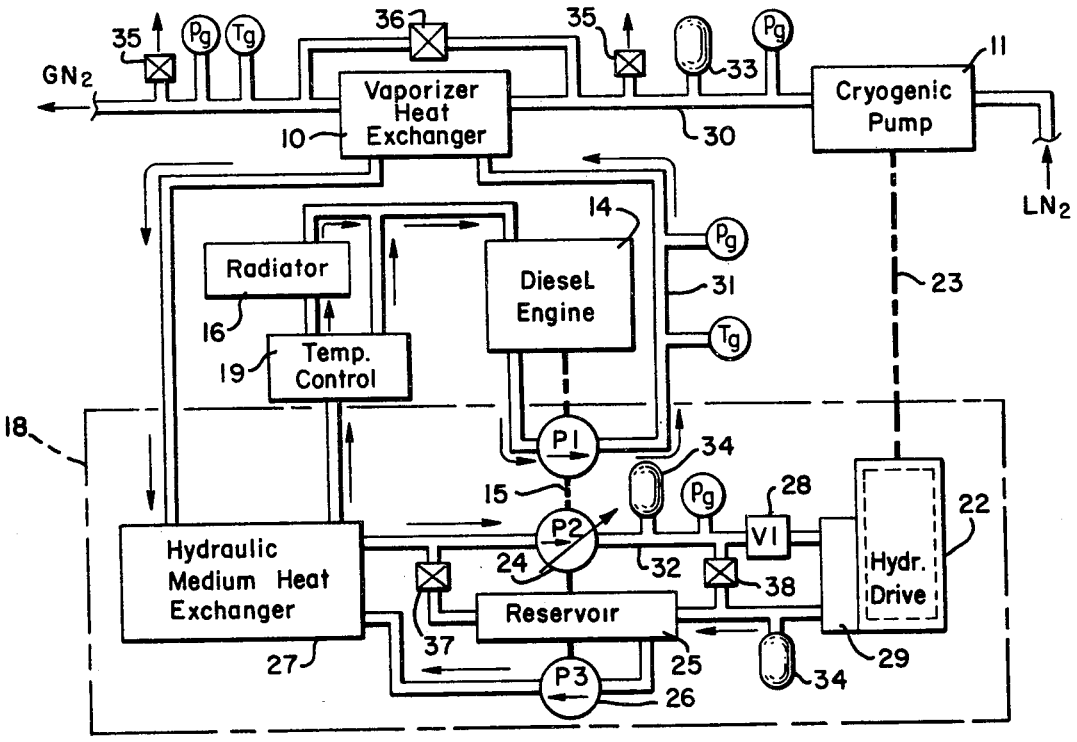
FIG. 2 is a more detailed schematic type block diagram of a vaporizer system in accord with an actual embodiment of the invention presently in use.

Referring now to FIG. 2, there are illustrated several of the basic components of FIG. 1 together with a first type of loading means enclosed within the dashed-dot lines 18 in accord with an actual embodiment of this invention presently in use. As mentioned, this particular embodiment is utilized to vaporize cryogenic liquid nitrogen and as depicted in FIG. 2, the liquid nitrogen ($LN_2$) is pumped from an appropriate supply tank through the cryogenic pump 11 to the vaporizer heat exchanger 10 and thence will emerge as gaseous nitrogen ($GN_2$).

The loading means 18 of FIG. 2 includes a hydraulic drive connected to the cryogenic pump 11 as indicated by the heavy dashed-dot line 23. A hydraulic pump 24 also designated P2 in in FIG. 2 is connected to the shaft 15 of the diesel engine 14 for circulating an appropriate hydraulic medium to operate the hydraulic drive 22. Thus, there is illustrated a hydraulic medium reservoir 25 from which the hydraulic medium is pumped by a further pump 26 to a hydraulic medium heat exchanger 27 and thence through the pump 24, back pressure valve 28, also designated V1, slide valve 29 for the hydraulic drive 22 and thence back to the reservoir 25.

The hydraulic medium heat exchanger 27 is in the flow path of the coolant medium passing from the vaporizer heat exchanger 10 to the temperature control 19 and radiator 16, this hydraulic medium heat exchanger serving to cool the hydraulic fluid.

In FIG. 2, the fluid flow path for the cryogenic liquid is indicated in the upper portion at 30, the circulating path for the coolant medium at 31 and the hydraulic circulating path at 32. Appropriate accumulators or surge tanks schematically indicated at 33 in the flow path 30 and 34 in the hydraulic medium flow path 32 may be provided for smoothing out the flow. In addition, safety pressure relief valves may be provided such as indicated in the flow path 30 at 35, and similarly pressure responsive bypass valves such as indicated at 37 and 38 on either side of the hydraulic medium reservoir 25 are provided.

A manual bypass valve 36 is provided to allow a small flow of liquid nitrogen around the vaporizer heat exchanger 10 to permit a reduction or "tempering" of the discharge temperature of the GN2 when this is desired.

Finally, there are depicted schematically in FIG. 2 various temperature gauges Tg and pressure gauges Pg in various ones of the circulating paths for monitoring purposes. These latter gauges would be located on the control panel 20 described in FIG. 1. It will be understood in an actual embodiment that further valves and gauges as well as surge tanks would be provided at appropriate locations along with priming valves and the like.

OPERATION OF THE EMBODIMENT OF FIG. 2

In FIG. 2, the hydraulic medium pump 24 connected to the diesel engine shaft 15 constitutes a hydrostatic transmission-variable displacement pump to enable adjustment of the flow rate of the hydraulic medium for a given back pressure set by the back pressure valve 28 in the flow line 32. It will be appreciated that the higher the back pressure provided by the valve 28 the greater will be the load applied to the shaft 15 by the pump 24 if the pump rate is to remain constant. Actually, a given back pressure is set by the valve 28 and the variable displacement pump 24 adjusted to provide a flow rate for the cryogenic liquid such that all the liquid will be vaporized by the heat generated in the engine and transferred by the coolant medium. In other words a proportionality between the flow rate and heat available for vaporizing the liquid is always maintained. The flow rate provided by the cryogenic pump 11 depends on the rate of operation of the hydraulic fluid through the hydraulic pump 24. Because the valve 28 maintains a constant back pressure on the hydraulic pump independent of the flow rate of hydraulic fluid, the power required to drive the hydraulic pump is proportional to the hydraulic fluid flow rate. Since the pump 24 is driven by the engine shaft, it will be appreciated that the engine power is proportional to the flow rate of the cryogenic liquid through the vaporizer heat exchanger 10. Further, the heat developed by the engine is approximately proportional to the power of the engine and thus for an increased flow rate there will be provided increased heat in the vaporizer heat exchanger 10 from the coolant medium passing through the diesel engine 14.

It will thus be evident from the foregoing that the available heat provided by the coolant medium in the vaporizer heat exchanger 10 is approximately equal to the heat required for complete vaporization of the cryogenic liquid at the particular flow rate. Essentially, the hydraulic drive and pump 24 embodied in the loading means 18 of FIG. 2 absorbs the diesel engine shaft power resulting in the generation of the necessary heat by the engine for vaporization.

It will be appreciated that the heat generated by the engine is not exactly proportional to the power generated. At low engine power levels and at very high speeds the heat generated per unit power increases. The engine generates a significant amount of heat even at idle conditions or when no power is being generated. To allow for these variations, the system must be designed so that the available heat always equals or exceeds the heat required to vaporize the cryogenic liquid. As a result, there will occur some regimes of engine operation where there is excess heat which must be dissipated.

The radiator 16, as mentioned briefly heretofore, serves to radiate away any excess heat above that necessary to effect the desired vaporization of the cryogenic liquid. Any such excess heat would be in the circulating coolant medium passing to the radiator by way of the temperature control 19. The temperature control 19 may comprise simply a thermally responsive valve arrangement to permit passage of the coolant medium directly to the diesel engine in the event no excess heat is present (the coolant medium simply bypasses the radiator 16), or pass a portion of the coolant medium through the radiator 16 to radiate away the excess heat. By utilizing a thermostatic control for the valve, the operation is completely automatic and self-regulating.

DESCRIPTION OF THE EMBODIMENT OF FIG. 3

Figure 3:
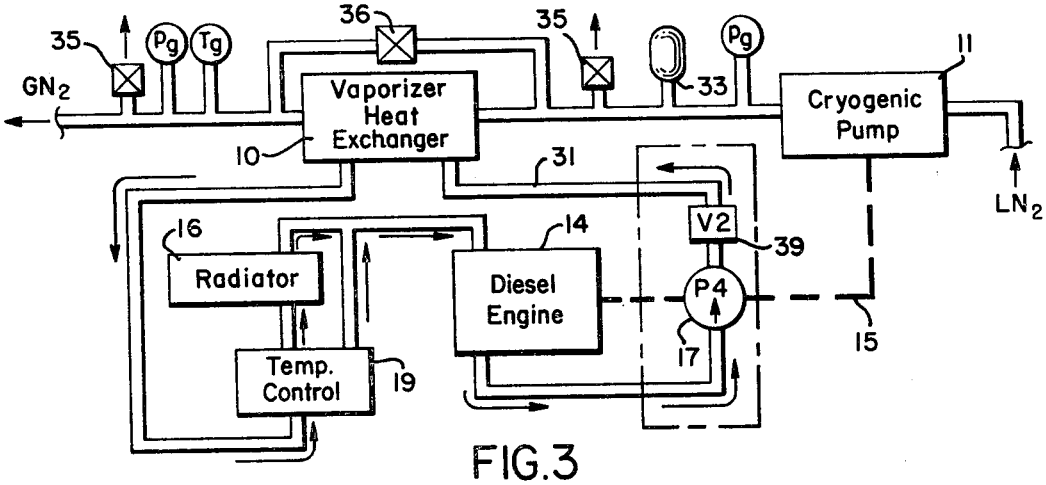
FIG. 3 is a schematic block diagram of a second embodiment of the invention.

FIG. 3 shows an alternative loading means 18 for providing the engine heat necessary for vaporization. In FIG. 3, the basic cryogenic pump 11, vaporizer heat exchanger 10, diesel engine 14, temperature control 19 and radiator 16 may all be essentially the same as described in FIGS. 1 and 2. However, rather than the hydraulic drive system as the loading means, loading is accomplished by providing a back pressure on the coolant medium itself.

More particularly, and as shown in FIG. 3, a special coolant pump 17 and also designated P4 is provided together with a back pressure valve 39 also designated V2 positioned in the circulating coolant path 31 between the pump 17 and vaporizer heat exchanger 10. By providing an appropriate back pressure on the coolant medium by means of the valve 39 against the coolant pump P4, the engine shaft can be loaded the necessary amount to cause the engine to generate sufficient heat to vaporize the cryogenic liquid flow through the vaporizer heat exchanger 10.

It will further be noted in FIG. 3 that the cryogenic pump 11 is also driven by the diesel engine shaft 15. As in the case of the embodiment of FIG. 2, there will thus be provided the desired proportional relationship between the cryogenic liquid flow rate and the heat generated and transferred by the coolant medium to the vaporizer heat exchanger 10 to assure complete vaporization. Again, the heat available at the heat exchanger is approximately equal to the heat required for complete vaporization at the particular flow rate.

As in the previous embodiment, the heat generated by the engine is not exactly proportional to the power generated and this will result in excess heat which must be dissipated at certain operating conditions. A further source of excess heat arises in the embodiment of FIG. 3 due to variation of the GN2 delivery pressure. When the GN2 delivery pressure is very low, the power absorbed by the cryogenic pump 11 will be small and hence the setting of valve V2 must be such that the necessary heat will be available for these conditions. When the GN2 delivery pressure increases to a high level, the pump 11 will absorb a significant amount of power leading to increased heat generation by the engine. This excess heat must be dissipated.

The temperature control 19 and radiator 16 in the coolant medium path function in the same manner as described in FIG. 2. In other words, the radiator is controlled to radiate away any excess of the amount required to vaporize the cryogenic liquid at its flow rate.

Figure 4:
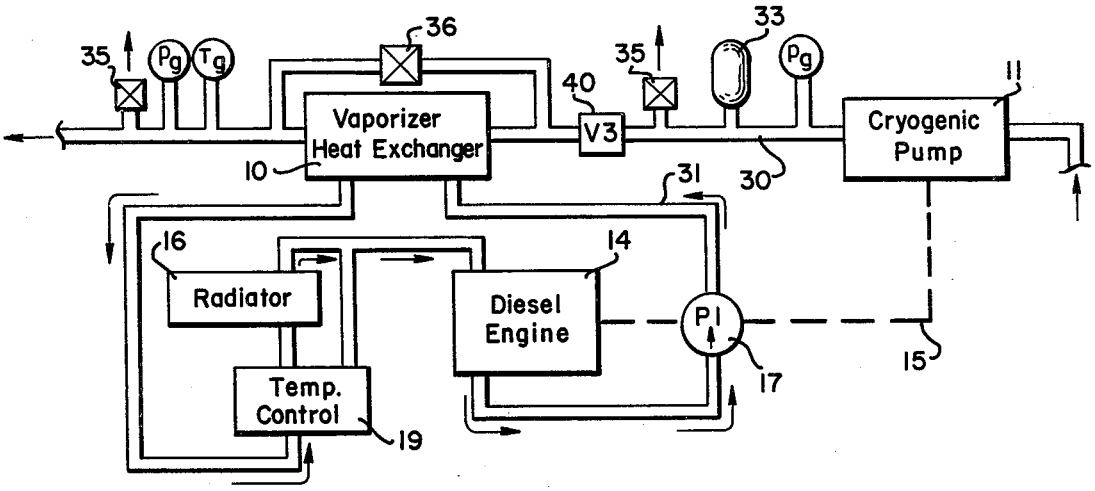
FIG. 4 is a schematic block diagram of a third embodiment.

Referring now to FIG. 4 there is shown a third embodiment of the invention wherein loading of the engine shaft power is accomplished by providing a back pressure valve 40 and also designated V3 in FIG. 4 between the cryogenic pump 11 and the vaporizer heat exchanger 10.

As in the case of backpressuring the coolant pump there is retained a direct proportionality between the degree of engine loading and the heat provided by the engine. Therefore there will be increased heat at the heat exchanger 10 with increased flow rate provided by the cryogenic pump. Since the engine shaft drives the cryogenic pump directly, the foregoing proportionality will be maintained.

In FIG. 4 the normal circulating pump 17 and designated P1 corresponding to that used in the FIG. 2 embodiment can be used. The remaining components in FIG. 4 are the same as those shown in FIG. 3 except that the backpressure valve V2 for the coolant pump in FIG. 3 is not used.

Figure 5:
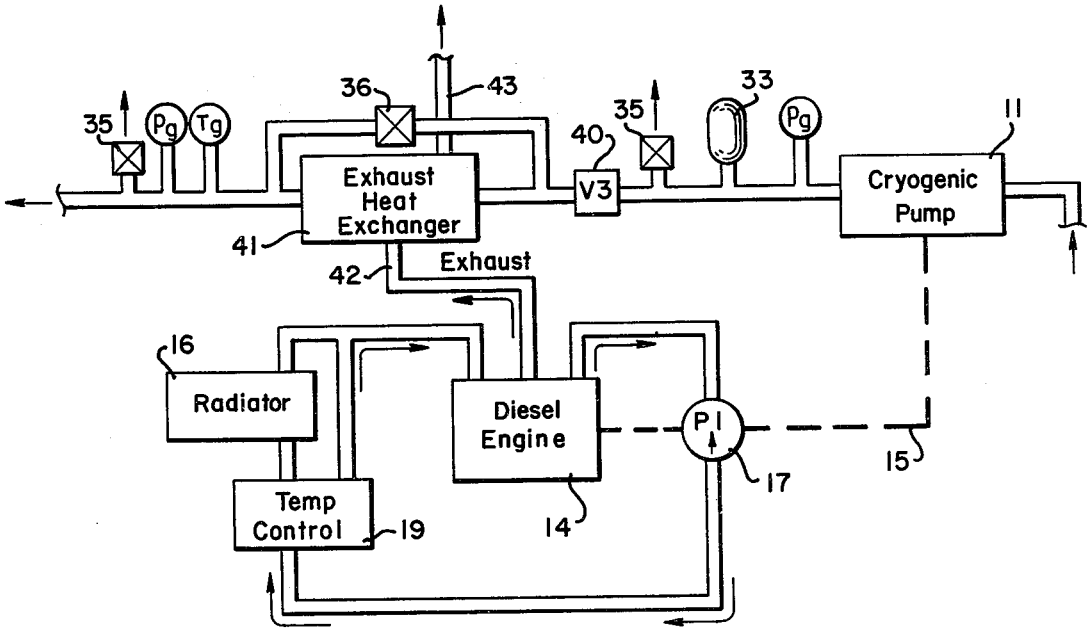
FIG. 5 is a schematic block diagram of a fourth embodiment.

FIG. 5 shows an alternative means for providing engine heat to the heat exchanger. In FIG. 5 a backpressure valve is used for loading the cryogenic pump as shown at V3 the same as in FIG. 4. However, rather than use the coolant medium for passing engine heat to the heat exchanger 10 an exhaust heat exchanger 41 is provided and exhaust heat from the diesel engine passed there through by way of lines 42 and 43.

The arrangement of FIG. 5 might best be used with the heating of carbon dioxide. For cryogenic liquids such as nitrogen the preferred system is that described in FIG. 2.

In so far as heat transfer from the engine to the heat exchanger is concerned, a coolant medium may be used, the exhaust may be used, or combination of both may be used depending upon the particular fluid involved.

As a specific example of an actual embodiment of the invention as described in FIG. 2, the back pressure provided on the hydraulic medium by the valve 28 may be on the order of 3,000 psi. The vaporizer heat exchanger and pump could typically provide from 40,000 to 54,000 standard cubic feet of nitrogen gas per hour at pressures up to 10,000 psi and at a temperature of 70° F. using a 120 Hp diesel engine.

From all of the foregoing, it will thus be seen that the present invention has provided a fluid pumping and heating method and system which takes advantage of both the work and heat available from the engine which drives the pump with the result of greater efficiency and further avoids the requirement for separate burners and the like and thus avoids the disadvantages associated therewith.

We claim:

1. A method of heating a fluid to a desired temperature including the steps of:
   (a) pumping the fluid along a flow path;
   (b) utilizing a heat engine which provides shaft power and heat;
   (c) utilizing a part of the shaft power of said engine to effect said pumping;
   (d) providing a back pressure to increase the pumping load on the engine so that the engine operates at a greater power level than would be necessary to effect the pumping in the absence of such back pressure to thereby provide increased heat from said engine; and
   (e) effecting a heat exchange between the engine heat and said fluid passing along said flow path to thereby heat said fluid, the amount of heat provided being directly proportional to the flow rate of said fluid whereby separate burners, direct fired units, boiler systems and the like are not required to heat said fluid.

2. The method of claim 1, in which said heat engine includes a radiator, a cooling medium for extracting part of said engine heat and a circulating pump driven by the engine shaft, and in which said step of effecting a heat exchange includes the steps of:
   (a) providing a heat exchanger in said flow path;
   (b) circulating said cooling medium by said circulating pump through said engine heat exchanger and radiator; and
   (c) controlling said radiator to radiate away any heat in excess of an amount required to heat said fluid to said desired temperature at its flow rate along said path as controlled by the rate of said pumping.

3. The method of claim 2, in which said step of providing a back pressure includes the steps of:
   (a) providing an hydraulic pump driven by the engine shaft for circulating a hydraulic medium;
   (b) providing a hydraulic drive in the circulation path of said hydraulic medium for operation by said hydraulic medium;
   (c) providing a fluid pump driven by said hydraulic drive for effecting the pumping of said fluid along said flow path; and
   (d) providing said back pressure by said hydraulic medium on said hydraulic pump to thereby load said engine shaft.

4. The method of claim 3, in which the heating of said fluid to its desired temperature results in its vaporization.

5. The method of claim 2, in which said step of providing a back pressure comprises providing said back pressure by said cooling medium on said circulating pump to thereby load the engine shaft.

6. The method of claim 2 in which said step of providing a back pressure includes the step of providing said back pressure by the fluid along said flow path to thereby load the part of the shaft power utilized to effect said pumping.

7. The method of claim 1, in which said step of providing a back pressure includes the step of providing said back pressure by the fluid along said flow path to thereby load the part of the shaft power utilized to effect said pumping.

8. The method of claim 7 in which said engine includes an exhaust line through which part of said heat passes, and in which said step of effecting a heat exchange comprises passing heat from said exhaust line in heat exchanging relationship with said fluid along said flow path.

9. A fluid pumping and heating system including, in combination:
   (a) a heat exchanger;
   (b) a fluid pump for passing a fluid to be heated to a desired temperature through said heat exchanger;
   (c) a heat engine which provides shaft power and heat output, part of said shaft power being used to operate said fluid pump and said heat being used in said heat exchanger; and
   (d) loading means including an adjustable valve for increasing the pumping load on the engine shaft required to overcome a back pressure created by the valve to thereby provide sufficient heat to heat said fluid in said heat exchanger to said desired temperature, the amount of heat provided being directly proportional to the flow rate of said fluid provided by said fluid pump whereby separate burners, direct fired units, boiler systems and the like are not required to vaporize said fluid.

10. A system according to claim 9, in which said loading means further includes a hydraulic drive connected to said fluid pump; and a hydraulic pump connected to the engine shaft for circulating a hydraulic medium to operate said hydraulic drive said valve being in the circulating path of said hydraulic medium for providing a back pressure on said hydraulic medium to thereby load said hydraulic pump and consequently said engine shaft.

11. A system according to claim 10, in which said hydraulic pump comprises a hydrostatic transmission-variable displacement pump to enable adjustment of the flow rate of said hydraulic medium for a given back pressure and thereby the flow rate of fluid by said fluid pump such that sufficient heat is provided by said engine in said heat exchanger to heat all of the fluid pumped through said heat exchanger to said desired temperature, the degree of loading of said engine being directly proportional to the fluid flow rate provided by said fluid pump so that the heat available at said heat exchanger is always sufficient to provide the heat required for the fluid to reach said desired temperature.

12. A system according to claim 11, including a coolant medium for said engine, a radiator for said coolant medium, a coolant pump driven by said engine for circulating said coolant medium through said engine, heat exchanger and radiator, and in which there is included a hydraulic medium heat exchanger in the circulating paths of said hydraulic medium and said coolant medium to effect heat exchange between said coolant medium after leaving said heat exchanger, and said hydraulic medium, and in which said system further includes temperature responsive control means for said radiator for automatically adjusting said radiator to radiate any heat in said coolant medium in excess of that required for heating said fluid to said desired temperature.

13. A system according to claim 12, in which said fluid constitutes a cryogenic liquid, the heating to said desired temperature vaporizing said fluid, and in which said fluid pump is a cryogenic pump, and said heat engine is a diesel engine, said heat exchanger, cryogenic pump, diesel engine, radiator, hydraulic drive, and hydraulic medium heat exchanger all being mounted on a skid structure to provide a portable system so that it may be transferred to an appropriate site and connected to a cryogenic liquid supply tank to vaporize the liquid and enable utilization of the resulting gas at the site.

14. A system according to claim 13, including temperature responsive control means for said radiator for automatically adjusting said radiator to radiate any heat in said coolant medium in excess of that required for complete vaporization so that the coolant heat available at said vaporizer heat exchanger is always sufficient to provide the heat required to effect complete vaporization of the fluid at the flow rate provided by said fluid pump.

15. A system according to claim 9 including a coolant medium for said engine, a radiator for said coolant medium and a coolant pump driven by said engine for circulating said coolant medium through said engine, heat exchanger and radiator, and in which said valve is in the circulating path of said coolant medium between said coolant pump and heat exchanger for providing a back pressure of the coolant medium.

16. A system according to claim 9, in which said valve is between said fluid pump and heat exchanger to load the part of the shaft power utilized to operate said fluid pump.

17. A system according to claim 9, in which said heat engine has an exhaust line through which heat passes, said exhaust line connecting to said heat exchanger to provide said engine heat.

18. A method of heating a fluid to a desired temperature including the steps of:

(a) pumping the fluid along a flow path;

(b) utilizing a heat engine which provides shaft power and heat;

(c) utilizing a part of the shaft power of said engine to effect said pumping;

(d) providing a hydraulic pump driven by the engine shaft for circulating a hydraulic medium;

(e) providing a hydraulic drive in the circulation path of said hydraulic medium for operation by said hydraulic medium;

(f) providing a fluid pump driven by said hydraulic drive for effecting the pumping of said fluid along said flow path;

(g) providing a back pressure of said hydraulic medium on said hydraulic pump to thereby load said engine shaft so that the engine operates at a greater power level than necessary to effect the pumping to thereby provide increased heat from said engine; and (h) effecting a heat exchange between the engine heat and said fluid passing along said flow path to thereby heat said fluid whereby separate burners, direct fired units, boiler systems and the like are not required to heat said fluid.

* * * * *